United States Patent [19]

Anderson

[11] 3,937,039

[45] Feb. 10, 1976

[54] ONE-PIECE PANTY AND STOCKINGS

[75] Inventor: Ronald W. Anderson, Bentonville, Ark.

[73] Assignee: Prenihan A.G., Zurich, Switzerland

[22] Filed: Oct. 22, 1968

[21] Appl. No.: 769,480

[52] U.S. Cl. ..... 66/177

[51] Int. Cl.² ..... A41B 11/02

[58] Field of Search ..... 66/175, 176, 177, 169, 66/170, 171, 54, 172, 189, 190, 146

[56] References Cited

UNITED STATES PATENTS

| | | | |
|---|---|---|---|
| 1,887,927 | 11/1932 | Fox | 66/180 |
| 1,981,136 | 11/1934 | Bloom | 66/176 |
| 2,028,746 | 1/1936 | Holden et al. | 66/170 |
| 2,111,472 | 3/1938 | Horn | 66/190 X |
| 2,115,627 | 4/1938 | Foster | 66/190 |
| 2,474,894 | 7/1949 | Gottschalck | 66/189 X |
| 2,833,134 | 5/1958 | Gift | 66/177 |
| 2,887,860 | 5/1959 | Bellman | 66/172 |
| 2,962,885 | 12/1960 | Knohl | 66/190 X |
| 3,052,110 | 9/1962 | Heggie | 66/172 |
| 3,109,301 | 11/1963 | Garrou et al. | 66/177 |
| 3,173,278 | 3/1965 | Kaylor | 66/187 X |
| 3,208,241 | 9/1965 | Frederick | 66/187 X |
| 3,232,079 | 2/1966 | Levine et al. | 66/55 X |
| 3,338,071 | 8/1967 | Dons et al. | 66/187 X |
| 3,449,932 | 6/1969 | Fillmore | 66/177 |
| 3,670,529 | 6/1972 | Fregeolle | 66/177 |
| 3,673,821 | 7/1972 | Johnson | 66/177 |

FOREIGN PATENTS OR APPLICATIONS

| | | | |
|---|---|---|---|
| 1,537,162 | 7/1968 | France | 66/177 |
| 1,262,178 | 3/1968 | Germany | 2/239 |

*Primary Examiner*—Ronald Feldbaum
*Attorney, Agent, or Firm*—Robert B. Frailey

[57] ABSTRACT

An improved one-piece circular knit pantyhose having an intermediate panty portion and two integral leg portions formed from a single rotary knit tubular blank, whereof the crotch area of the panty portion is formed of more tightly knit stitches than the remainder of the panty portion to impart to the panty portion a continuous longitudinal curvature.

7 Claims, 18 Drawing Figures

Inventor
RONALD W. ANDERSON

BY

Prangley, Baird, Clayton, Miller & Vogel
ATTYS.

Inventor
RONALD W. ANDERSON
BY
Prangley, Baird, Clayton, Miller & Vogel
ATTYS.

Inventor
RONALD W. ANDERSON
BY
Prangley, Baird, Clayton, Miller & Vogel
ATTYS.

Inventor
RONALD W. ANDERSON
BY
Prangley, Baird, Clayton, Miller & Vogel.
ATTYS.

ONE-PIECE PANTY AND STOCKINGS

SUMMARY OF THE INVENTION

The primary object of this invention is to provide a new and improved one-piece circular knit panty-hose formed from an integral rotary knit tubulr blank having two leg portions joined by an intermediate panty portion, the latter having a continuous longitudinal curvature or curved configuration. The panty portion of the blank, following knitting, is slit in a wale-wise direction to form a waist opening, and an elastic waist band is attached thereto. The toe portions of the blank are closed in any conventional manner, and the garment then dyed and finished.

The curved configuration of the panty portion of the blank preferably is achieved by forming the crotch area of the panty portion of tighter or smaller stitches than the remaining are of the panty portion. However, it also may be realized by incorporating an elastic material into the crotch area under high tension.

DESCRIPTION OF THE VIEWS OF THE DRAWING

The invention, together with other objects advantages thereof, will best be understood by reference to the following specification, taken in connection with the accompanying drawings in which.

Figure 1:
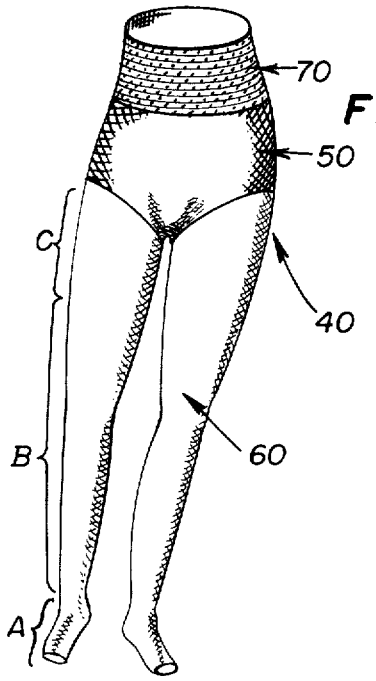
FIG. 1 is a front perspective view of one embodiment of a one-piece seamless garment of the present invention.
Figure 2:
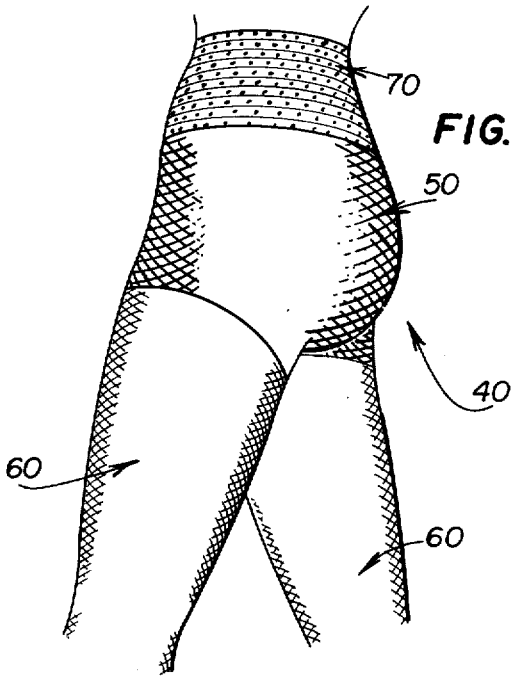
FIG. 2 is a side perspective view of the garment of FIG. 1, illustrating the configuration thereof when the garment is disposed on the body of a user thereof.

Referring still to the drawings, and more particularly to FIGS. 1 and 2 thereof, there is illustrated a combination one-piece garment 40 which includes a panty portion 50 that extends substantially from the crotch area to the waist of the associated wearer so as to cover the lower portion of the torso of the associated wearer. The garment 40 further includes a pair of seamless stocking portions 60 integrally knit with the panty portion 50 thereby to provide the one-piece seamless construction.

As illustrated in FIG. 1, each stocking portion 60 includes a foot section "A", a leg section "B" and a thigh engaging section "C". As illustrated in FIGS. 1 and 2, the garment 40 also is provided with a waist band 70 which is connected to the upper edge of the panty portion 50, the waist band 70 extending for a substantial distance above the upper edge of the panty portion 50 thereby to lengthen same.

The details of construction of the complete garment 40 will be described specifically with reference to the method of making the embodiment thereof illustrated in FIGS. 1 and 2, however, it should be understood that the description of the embodiment of the garment illustrated in FIGS. 1 and 2 is not intended in any limitative sense.

Figure 3:
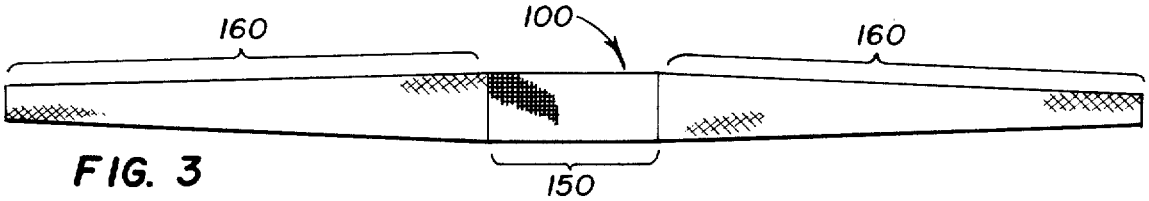
FIG. 3 is a plan view of a generally tubular blank knit to provide the one-piece seamless garment of the present invention.

The method of making the one-piece seamless garment 40 of the type illustrated in FIGS. 1 and 2 will best be understood with reference to FIGS. 3 through 7 of the drawings. There is illustrated in FIG. 3 an elongated and generally tubular knit blank 100 which includes a center section 150 of fairly uniform diameter and two identical and outwardly extending stocking portions 160 each of gradually decreasing diameter away from the center section.

In knitting the tubular blank 100, each stocking portion 160 is formed of a plurality of integrally knit sections of different longitudinal and circumferential dimensions. For example, with reference to FIG. 4, each stocking portion 160 of the tubular blank 100 may be knit so that it includes a selvedge section 161 at the outer end thereof followed by a toe section 162; a lower runguard section 163; a lower foot and ankle section 164; a lower boot section 165, the lower boot section 165 including a portion 166 which gradually increases in diameter beginning at the end thereof adjacent to the foot and ankle section 164; an upper boot section 167, including a portion 168 which gradually increases in diameter beginning at the end thereof adjacent to the lower boot section 165; and an upper runguard section 169. It will be appreciated that the lower boot section 165 begins where the tubular blank 100 first begins to increase in diameter at the portion 166 thereof and the upper boot section 167 begins where the tubular blank 100 again begins to increase in diameter as at the portion 168 thereof.

The entire tubular blank 100 preferably is knit of a thermo-plastic stretch yarn to provide stretchability therefor. The term "stretch" is intended to include all types of mono-filament and multi-filament yarns capable of providing the desired stretch and shape characteristics for the finished garment. Also, as pointed out hereinafter, various sections of the tubular blank may be knit of different denier yarn or different stitch patterns, or the tubular blank may consist of a single yarn knit in a single stitch pattern.

For example, the tubular blank 100 may be knit of a lively torque yarn which has been twisted to provide sufficient torque to cause distortion of the knit stitches. Yarns having torque in opposite directions are usually knit in alternation to balance the overall torque in the stocking. The tubular blank 100 also may be knit of a "non-torque" or bicomponent type crimped or curled thermo-plastic yarn which does not require alternate knitting. The crimp or curl may be set in the yarn by passing it through a heated stuffer box, passing it over a heated blade, passing it between gear teeth, passing it through an air jet, or by other known means.

The tubular blank 100 also may be knit of any type of stitch patterns or of mulltiple types of stitch patterns. For example, the foot and ankle sections 164, the lower boot sections 165 and the upper boot sections 167 may be knit of flat knit, micro-mesh or non-run stitches. The toe sections may be knit by reciprocation with a heavier reinforcing yarn, in the usual manner, while the lower and upper boot sections 165 and 167 of each stocking portion 160 may be knit of the same yarn as the foot and ankle section 163 and preferably forming a pattern of plain and tuck stitches of the type commonly referred to as micro-mesh which results in greater fabric wear as well as preventing downward runs. The lower and upper runguard sections 163 and 169 preferably are formed of a lock stitch pattern whereby runs in the stocking portion 160 won't be transmitted to the center section 150. The micro-mesh tuck stitch pattern may be continued into the center section 150 of the tubular blank where a heavier denier reinforcing yarn preferably is added.

It will be understood that the tubular blank 100 is continuously and integrally knit so as to first provide the various sections of one of the stocking portions 160 beginning with the selvedge section 161, followed by knitting of the center section 150 and then the opposite stocking portion 160. After the tubular blank 100 is knit, it is steamed or preset in the conventional manner to a predetermined size which is substantially equivalent to the final size of the finished garment.

After presetting the tubular blank 100, a longitudinally extending slit 180 (FIG. 5) of predetermined extent is made in the center section 150, whereby upon orienting both of the stocking portions 160 in the same direction away from the longitudinal axis of the tubular blank 100, the slit 180 in the center section 150 defines a generally annular waist opening in the tubular blank 100 (FIG. 6), the slit center section 150 thereby providing the panty portion 50 for the finished garment 40 illustrated in FIGS. 1 and 2. Depending upon the length and diameter of the center section 150 and the extent of the slit 180 made therein, the slit edge of the center section which defines the upper edge of the panty portion will be disposed at a predetermined point on the lower torso of the associated wearer.

Figure 7:
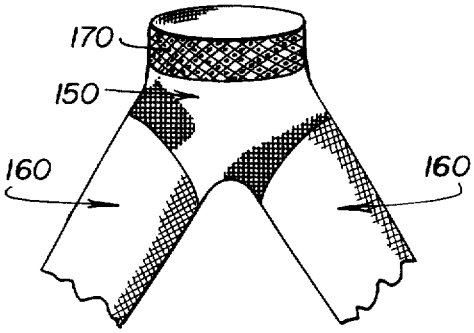
FIG. 7 is a front perspective view of the embodiment illustrated in FIG. 6, wherein a waist band has been connected to the slit upper edge of the panty portion of the garment so as to lengthen same.

To close off the slit edge 180 of the center section, an annular waist band such as 170 is sewed thereto. The waist band 170 may be formed of a highly elastic material so as to provide a support function for the lower torso area. Also, in certain instances, it may be desirable to lengthen the panty portion 50 so that the upper edge thereof is disposed higher on the body of the wearer. In this case the waist band 170 may be of substantial width such as illustrated in FIGS. 1, 2 and 7.

In addition to sewing the waist band 170 to the slit edge 180 of the tubular blank 100, the outer edge of each toe section 162 is cut and seamed along a dashed line 182 thereof (FIG. 4), whereby each stocking portion 160 is closed at the outer end thereof so as to provide the foot section "A" for the finished garment 40.

It will be understood that the seaming of each of the toe sections 162 to close same is a conventional operation and that the nomenclature "seamless" as used herein with reference to the one-piece garment is intended to refer to all sections of the garment with the exception of the seams at the toes and the waistband. After both toe sections are seamed, the slit tubular blank 100 may be put on an appropriate structure for stretching and boarding the same so as to impart the predetermined configuration thereto resulting in the finished garment 40 illustrated in FIGS. 1 and 2.

In a preferred embodiment of the invention, the tubular blank 100 will be knit such that each of the toe sections 162 has between 170 and 180 courses, each of the lower runguard sections 163 has about 16 courses; each of the foot and ankle sections 164 has between 725 and 745 courses; each of the lower boot sections 165 has between 975 and 1005 courses, with the tapered portion 166 thereof comprising about one-fifth of such courses; each upper boot section 167 has between 700 and 740 courses, with the tapered portion 168 thereof comprising about half of such courses; and the center section 150, including the upper runguard section 169, has between 910 and 980 courses.

In a typical embodiment, the tubular blank 100 will be knit to include the various sections set forth herebelow from the selvedge 161 thereof to the center section 150 and then repeated in the opposite order for the remainder of the tubular blank. For example, the selvedge may consist of about 16 courses of lock yarn such as 100 denier Englo Rayon having a maximum diametrical stretch extent of about 10.5 inches. The toe section 162 may consist of about 175 equal diameter courses formed of 50/1/S/2 denier material knit of right and left twist alternately and having a maximum diametrical stretch extent of about 10.5 inches. The lower runguard section 163 may consist of about 16 courses of a 50 denier material knit with a lock stitch and having a maximum diametrical stretch extent of about 10.5 inches.

The foot and ankle section 164 may consist of about 735 equal diameter courses of a 50 denier material knit of a micro-mesh stitch and having a maximum diametrical stretch extent of between 10.5 and 11.0 inches.

The lower boot section 165 may consist of about 990 courses of a 15 or 20 denier material knit in a micro-mesh stitch pattern, the tapered portion 166 thereof consisting of about 200 courses, or about one-fifth of the total, the taper being imparted to the lower boot by increasing the diameters of the courses in four course intervals so that the portion 166 has a maximum diametrical stretch extent of about 10.5 inches at the end thereof adjacent to the foot and ankle section and tapers outwardly so that the maximum diametrical stretch extent at the enlarged end is about 12.25 inches.

The upper boot section 167 consists of about 720 courses of a 17 or 20 denier material knit of a micromesh stitch, the tapered portion 168 thereof comprising about 350 courses or about one-half of the total, the taper being imparted thereto in four course intervals so that the portion 168 has a maximum diametrical stretch extent of about 12.25 inches at the end thereof adjacent to the lower boot section and tapers outwardly so that the enlarged end thereof has a maximum diametrical stretch extent of about 15.5 inches.

The upper runguard section 169 consists of about 16 courses of a 50 denier material knit in a lock stitch pattern, and the center section 150 consists of about 400 equal diameter courses (including the 32 courses of both upper runguard sections 169) of a 50/1/S/2 denier material knit in a plain flat knit, or micro-mesh pattern and having a maximum diametrical stretch extent of about 16.5 inches. Because the central section 150 is knit of a heavier denier material, the panty portion 50 of the finished garment 40 gives the appearance of a separate garment which supports the stocking portions 60.

It will be understood that the foregoing dimensions and limitations of the preferred embodiment are exemplary only and that the different materials and stitch patterns and sizes may be used to provide a great variety of one-piece seamless garments. The phrase "diametrical stretch extent" used herein refers to that dimension measured normal to the longitudinal axis of the tubular blank with the blank being stretched to its maximum in such direction.

Figure 4:
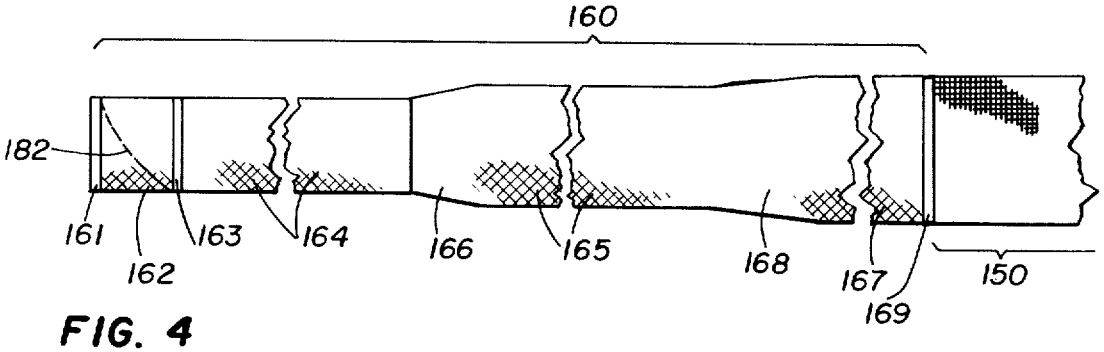
FIG. 4 is an enlarged view of the left-hand portion of the tubular blank of FIG. 3, illustrating further details of one of the stocking portions thereof.
Figure 5:
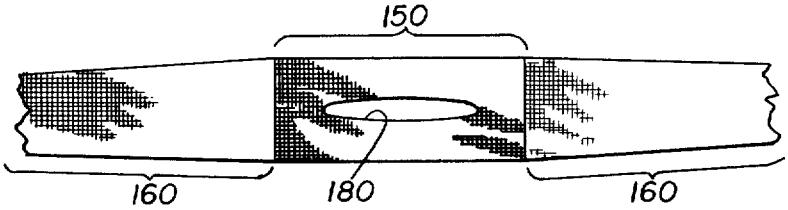
FIG. 5 is an enlarged fragmentary view of the center section and stocking portions of the tubular blank of FIG. 2, illustrating the longitudinal slit in the center section of the tubular blank which slit provides the waist opening for the finished garment.
Figure 6:
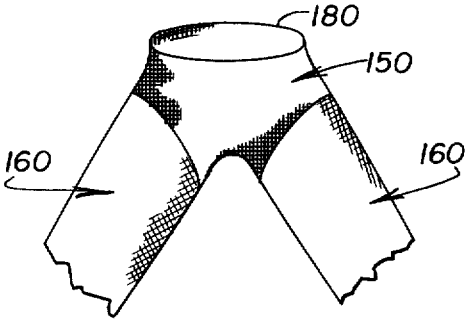
FIG. 6 is a front perspective view of that portion of the tubular blank illustrated in FIG. 5, with the stocking portions thereof being oriented away from the longitudinal axis of the tubular blank.

As previously stated, in manufacturing the tubular blank 100 illustrated in FIGS. 3 and 4, a substantially conventional circular knitting machine may be used. To impart the necessary configuration to the tubular blank 100, a fashioning cam or graduation wheel on the control drum of the machine may take the shape illustrated as 800 in FIG. 18. The cam 800 will be employed in lieu of the conventional fashioning cam or graduation wheel which is used in the machine for knitting conventional stockings which gradually increase in diameter toward the upper welt thereof.

Figure 18:
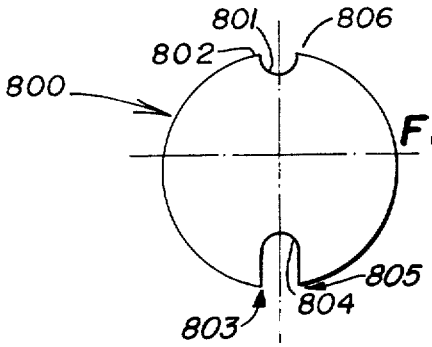
FIG. 18 is a front view of a graduation cam which is usable with otherwise conventional circular knitting machines whereby the tubular blank illustrated in FIG. 3 can be continuously and integrally knit on such machines.

When the cam 800 is used on an eight feed machine, for example, the machine will make up on four feeds and run a predetermined number of courses of selvedge 161. An additional four feeds are then brought in and the toe section 162 and lower runguard section 163 are knitted using the heavier denier material. When the toe section 162 is finished, the machine begins to size from the graduation cam 800 as illustrated in FIG. 18. As the machine makes the first foot and ankle and lower and upper boot sections, the stitches are loosened gradually by the cam 800 to produce the proper foot and ankle and lower and upper boot measurements.

When the first stocking portion 160 is finished, the heavier denier material is inserted in the machine for knitting the center section 150 which will ultimately become the panty portion 50 of the garment 40. At this time the machine will be sizing from a series of cams on the control drum. When the machine changes to the heavier denier material to make the center section 150, it will start with the upper runguard section 169, then run a plain knit pattern through the center section 150, and then make another upper runguard section 169 at the opposite end of the center section 150.

At this time, the machine will then be changed to the type of material for the second stocking portion and the machine will be sizing from the fashioning cam 800 again. To make the second stocking portion, the stitches will be gradually shortened to produce the proper measurement first in the upper boot section 167 and then in the lower boot section 165 and ultimately in the foot and ankle section 164. When the upper and lower boot sections and the foot and ankle section are finished, the machine will be changed to a heavier denier material so as to complete the tubular blank 100 by providing a second or lower runguard section 163, the toe section 162 and then end with a number of courses of selvedge 161.

The cam 800 is eccentric as illustrated in FIG. 18 and rotates one full cycle for each tubular blank 100 to be knitted. The first stocking portion will start at the midpoint of the cut-away portion designated as 801 on the cam, and the first foot and ankle section starts at the low point 802 thereon. As the first stocking portion is made the cam 800 will rotate approximately 180°, gradually raising the needle cylinder and loosening the stitches to form the foot and ankle section 162 and the lower boot section 165 and upper boot section 167 of that stocking portion, ultimately ending at the high point 803 on the cam. The cam is provided with a second cut-out portin 804, and, as the cut-out portion 804 rotates through the cycle, the center section 150 of a predetermined diameter will be knit. When the second stocking portion starts, the cam 800 is again at a high point 805, and upon continued rotation thereof, gradually lowers the needle cylinder throughout the knitting of the second stocking portion to form the various sections thereof, the cam 800 ultimately ending at the low point 806. The cam is thereagain cut-away at 801, and it is at the cut-away portion 801 that the sizing of the second toe section occurs. The pattern generated by the cam surface from the point 805 to 806 is identical to that generated between 802 and 804, so that the stocking portions 160 are symmetrical.

The eccentric cam surface extending from point 802 to point 803 causes the needle cylinder to rise gradually during the knitting of the first leg portion of the garment, to gradually increase the size of the knitted stitches as knitting progresses. The eccentric cam surface extending from point 805 to point 806 causes the needle cylinder to descend gradually during knitting of the second stocking portion, thereby causing the stitches to be more tightly knit as knitting progresses.

Although stretch yarns of different denier have been employed in the center section 150 of the tubular blank 100 and found to be satisfactory, inelastic yarns may be employed with satisfactory results. It is contemplated that with an inelastic yarn being fed to the needles in the usual manner, added elasticity may be provided in the center section 150 by either knitting or laying in without interknitting a highly elastic yarn into the fabric at selected courses or in all the courses of the center section. Also, it may be desirable to interlay yarns of a different denier or of different stretch characteristics in certain areas of the center section in order to provide different functional or decorative features in the finished garment. Various embodiments of the invention wherein different denier yarns are interlaid in the center section of the tubular blank are illustrated in FIGS. 8 through 17.

Figure 8:
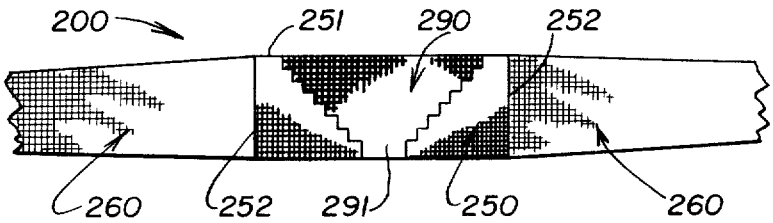
FIG. 8 is a fragmentary front view of a second embodiment of the invention wherein the center section of the tubular blank is provided with a panel of a different denier material interlaid therewith.
Figure 9:
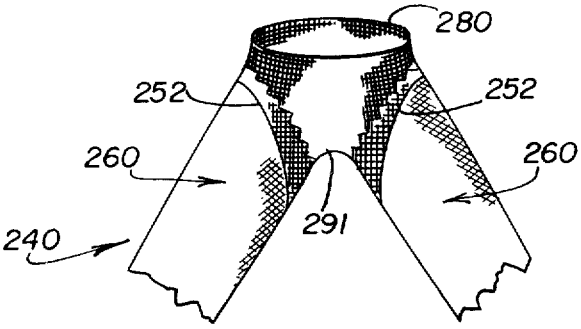
FIG. 9 is a front perspective view of the portion of the tubular blank illustrated in FIG. 8 after the center section has been slit to provide a waist opening therein and the stocking portions have been oriented away from the longitudinal axis of the tubular blank.

In the embodiment illustrated in FIGS. 8 and 9, the tubular blank 200 is provided with a continuous body panel designated as 290. The body panel 290 is formed by interlaying a different denier material in the center section 250 while knitting the center section. The different denier material or yarn is preferably of a heavier denier and may be interlaid in the center section so as to define the configuration illustrated in FIG. 8. The panel 290 is formed by interlaying the yarn thereof over only a part of the circumference of the tubular blank 200 for a predetermined number of courses, with the circumferential extent of the panel 290 increasing toward the midpoint of the center section 250 and then decreasing thereafter. In the embodiment illustrated, the body panel 290 is continuous over the entire circumference of the tubular blank at the midpoint of the center section, designated as 291. The slit 280 defining the waist opening for the garment is made along the upper edge 251 of the tubular blank, whereby when the stocking portions 260 of the tubular blank 200 are oriented away from the longitudinal axis thereof, the continuous section 291 of the panel 290 will be disposed in the crotch area of the finished garment 240.

The panel 290 in the embodiment illustrated in FIG. 9 thus extends from the upper edge of the front side of the panty portion 250 downwardly to and through the crotch area and then upwardly along the rear side to the upper edge of the panty portion. In addition, the sides of the panel taper inwardly from the upper edge of the panty portion toward the crotch area. It also will be appreciated that the panel 290 need not be continuously formed if desired.

The line designated as 252 between each stocking portion 260 and the center section 250 indicates only that the center section 250 may be knit of a different denier material than the stocking portions 260. The difference in denier delineates the panty portion of the finished garment from the stocking portions thereof.

Figure 10:
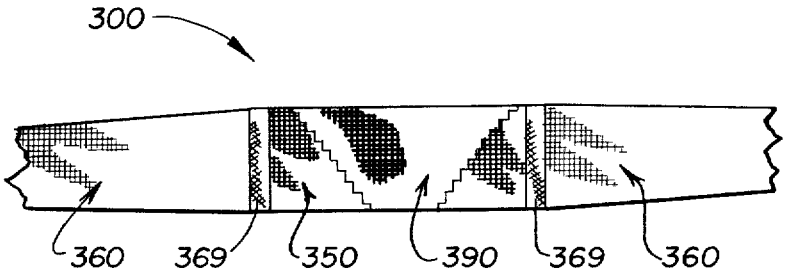
FIGS. 10 and 11 are views similar to FIGS. 8 and 9, but illustrate a third embodiment of the invention wherein the tubular blank is provided with upper runguard sections between each stocking portion and center section.
Figure 11:
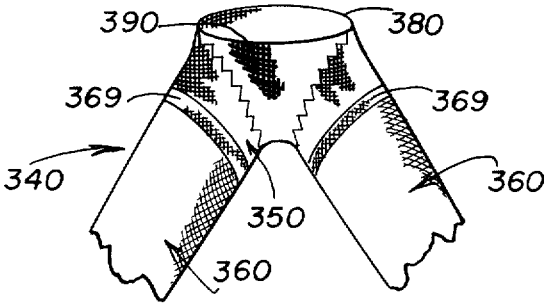

In the embodiment of the invention illustrated in FIGS. 10 and 11, the tubular blank 300 is provided with a panel 390 similar to that designated as 290 in the embodiment illustrated in FIGS. 8 and 9. In addition, the tubular blank 300 is provided with enlarged runguard sections 369 intermediate each stocking portion 360 and the center section 350, whereupon orienting the stocking portions 360 downwardly, the finished garment 340 will appear as illustrated in FIG. 11. The enlarged runguard sections 369 cause the finished garment 340 to appear as a separate panty with stockings supported thereby.

Figure 12:
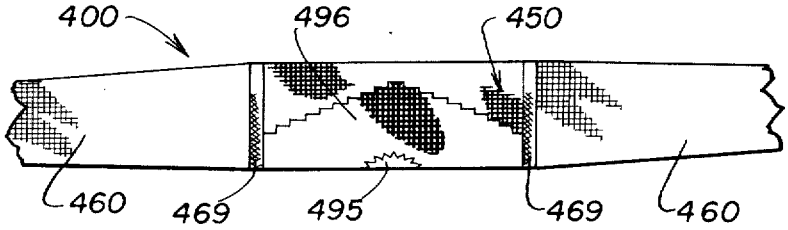
FIGS. 12 and 13 are views similar to FIGS. 8 and 9, respectively, and illustrate a fourth embodiment of the invention wherein the tubular blank is provided with upper runguard sections adjacent the center section and a plurality of panels of different denier materials are interlaid in the center section.
Figure 13:
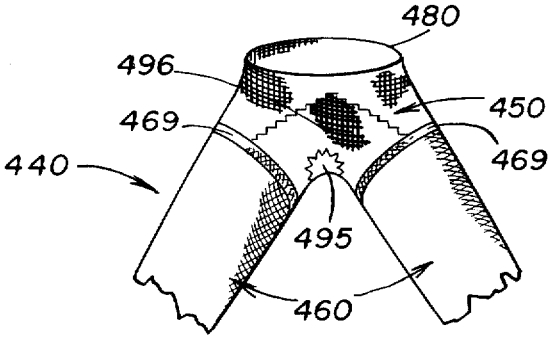

Still another embodiment of the invention is illustrated in FIGS. 12 and 13, wherein in addition to the enlarged runguard sections 469, a plurality of panels of different denier material are interlaid in the center section 450 of the tubular blank 400. In this embodiment, a panel 495 of limited longitudinal and circumferential extent is interlaid in that area of the center section 450 which will ultimately define the crotch area of the garment 440 as illustrated in FIG. 13. A second much larger panel 496 also is provided in the center section 450, the second panel 496 extending between the runguard sections 469 and upwardly along the front and rear sides of the panty portion toward the upper edge thereof, whereby the finished garment 440 will appear as illustrated in FIG. 13. It will be understood that the panels 495 and 496 may be formed of different denier material and that the center section 450 and stocking portions 460 also may be knit of different denier material.

Figure 14:
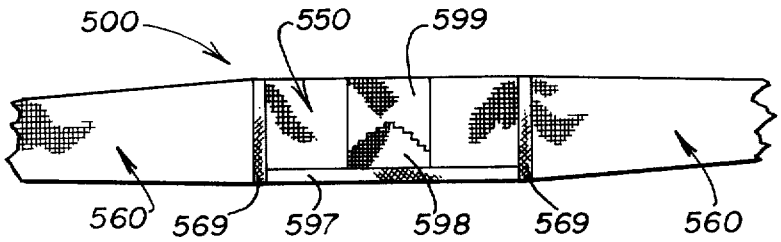
FIGS. 14 and 15 are views similar to FIGS. 8 and 9, respectively, and represent still another embodiment of the invention.
Figure 15:
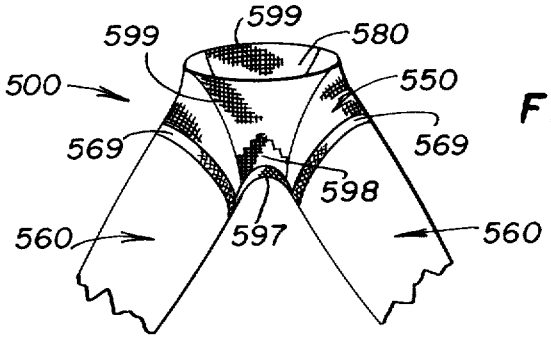

Still another embodiment of the invention is illustrated in FIGS. 14 and 15. In this embodiment, the center section 550 of the tubular blank 500 is provided with a longitudinally extending panel 597 which extends between the runguard sections 569. The panel 597 wil ultimately be disposed in the crotch area of the garment and for the sake of convenience will be referred to as a crotch panel. In addition, the tubular blank 500 further is provided with a pair of body panels 598; the body panels 598 being disposed on the front and rear sides of the center section and being roughly semicircular in shape whereby they taper inwardly from the crotch area toward the upper edge of the panty portion. In addition to the body panels 598 and the crotch panel 597, the tubular blank 500 further is provided with front and rear mesh bands 599 which extend upwardly from the body panels 598 to the upper edge of the center section. The mesh bands 599 are continuously knit as part of the tubular blank by appropriate adjustment of the knitting machine so as to provide the mesh type stitch pattern therefor.

Figure 16:
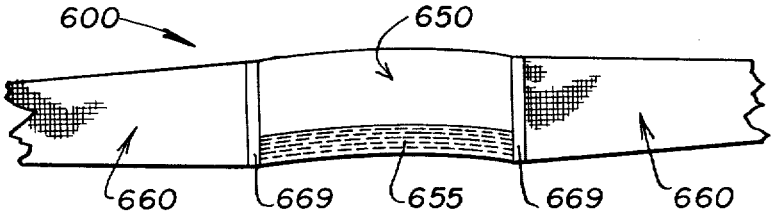
FIGS. 16 and 17 are views similar to FIG. 10 and illustrate further embodiments of the invention.

Another embodiment of the invention is illustrated in FIG. 16 wherein the tubular blank 600 is provided with runguard sections 669. The center section 650 includes a longitudinally extending lower section 655 of limited circumferential extent formed of a more closely knit stitches than the remainder, i.e. upper area, of the center section 650. The longitudinally extending arcuate panel 655 extends continuously between the runguard sections 669 and ultimately will be disposed in the crotch area of the finished garment. Because of the more tightly knit stitches, the center section of the tubular blank 600 will have a slight predetermined longitudinal bow as illustrated in FIG. 16, and when the finished garment is worn, the section 655 thereof will more fully conceal the underlying body area as though such section were made of a heavier denier material. The knitting machine may be set by any means well known to experts in the art, to produce in the knitted structure 650 a panel 655 of closer knitted stitches extending longitudinally of the fabric. The knitting technique employed may be the same as that referred to in U.S. Pat. Nos. 1,981,136 and 2,028,746. As explained in those patents, the closer knit portion of the center section 650 of tubular blank 600 foreshortens the tubular structure of the center section so that it assumes an arcuate form.

It is preferred, during knitting of the upper area of center section 650, to lower the stitch cams at the yarn feeds axially of the needle cylinder a slight, selected amount, to permit the needles knitting that area to draw longer yarn loops. During knitting of the lower portion 655 of center section 650, the stitch cams are at their normal higher position.

Preferably, the arcuate panel 655 comprises approximately one third of the total peripheral area of center section 650. By reason of the arcuate panel 655 being formed of more closely knit stitches, the tubular blank 600 is made shorter longitudinally in its crotch area.

There are many well known mechanisms for raising and lowering stitch cams to vary selectively the length of the knitted stitches in the courses which are being formed by the knitting machine. Any such mechanisms may be employed to provide the tubular blank illustrated in FIG. 16, such as those disclosed in U.S. Pat.

Nos. 2,699,055, 3,029,619, 3,157,037, 3,256,716, 3,342,042, 3,411,326 and 3,521,467.

Figure 17:
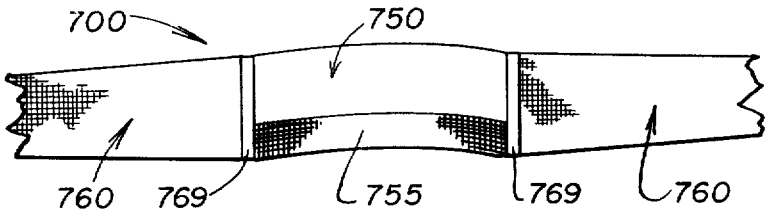

In the embodiment illustrated in FIG. 17, the tubular blank 700 is provided with a longitudinally extending arcuate section 755 of a highly elastic material interlaid at a greater tension in the center section, thereby tightening up the crotch area of the center section and imparting a bow in the center section thereof, thereby to more closely conform to the adjacent underlying body area.

From the foregoing, it will be appreciated that various modifications may be made in the center section of the garment to impart various designs thereto by interlaying different types of yarn therein. In the embodiments illustrated wherein a body panel or crotch panel is provided in the center section, the yarn forming such panels may be interknit or interlaced in the center section of the tubular blank. The distribution of such yarn and the type of yarn used may be varied as well as the number of strands thereof which are to be interlaid in each course.

While there has been described what are at present considered to be the preferred embodiments of the invention, it will be understood that various modifications may be made therein, and it is intended to cover in the appended claims all such modifications as fall within the true spirit and scope of the invention.

What is claimed is:

1. A one-piece panty hose having two leg portions and an intermediate panty portion, which garment comprises a single continuous circular knit tube, the panty portion of which has a longitudinally extending arcuate panel providing a crotch area, said arcuate panel incorporating an elastic material under a high tension to impart a continuous longitudinal curvature to the panty portion.

2. A seamless, circular knit lower body covering type garment comprising a. a seamless curved panty portion having integrally formed downwardly depending leg portions defining a crotch area therebetween, b. said seamless curved panty portion having an upper waist opening and an elastic band attached to the waist opening, c. the size of the stitch loops in courses of at least said curved panty portion being reduced from large stitch loops positioned in a wale extending along opposite sides of said panty portion to small stitch loops inner sides of said leg portions and through the center of said crotch area, the curvature in the panty portion being produced solely by reducing the size of the stitches.

3. A garment according to claim 2 wherein the reduction in size of the stitch loops in the panty portion is sufficient to impart to the panty portion a continuous longitudinal curvature.

4. A seamless panty hose type garment comprising a. a pair of seamless legs having closed toe ends at their lower ends, b. a seamless curved panty portion having downwardly depending leg portions defining a crotch area therebetween said leg portions being integrally knit with the upper ends of said seamless legs, c. an elastic waistband connected to the upper end of said curved panty portion and defining a waist opening therein, and d. the size of the stitch loops in courses of at least the curved panty portion being reduced from large stitch loops positioned in a wale extending along opposite sides of said panty portion to small stitch loops positioned in a wale extending along the inner sides of said leg portions and through the center of said crotch area, the curvature in the panty portion being produced solely by reducing the size of the stitches.

5. A method of forming a panty hose type garment comprising the steps of a. knitting a tubular panty hose blank on a circular knitting machine by continuously knitting from one end of the garment blank to the other and while b. knitting a first leg, c. knitting a curved intermediate panty portion, d. knitting a second leg, e. reducing the size of the stitch loops in courses of at least said panty portion from large stitch loops along one side of said blank to small stitch loops along the opposite side of said blank, to provide a curvature in the panty portion solely by reducing the size of the stitches, f. slitting the intermediate portion of said panty hose blank in a walewise direction and along said one side to form a waist opening therein, and g. attaching an elastic waistband to the waist opening formed by the slit.

6. A seamless, circular knit lower body covering type garment comprising a. A seamless curved panty portion having integrally formed downwardly depending leg portions defining a crotch area therebetween, b. said seamless curved panty portion having an upper waist opening and an elastic band at the waist opening, c. the size of the stitch loops in courses of at least said curved panty portion being stepped from large stitch loops positioned in a wale extending along opposite sides of said panty portion to small stitch loops positioned in a wale extending along the inner sides of said leg portions and through the center of said crotch area, the curvature in the panty portion being produced solely by reducing the size of the stitches.

7. A method of forming a panty hose type garment having a waist opening provided with an elasticated waistband comprising the steps of a. knitting a tubular panty hose blank on a circular knitting machine by continuously knitting from one end of the garment blank to the other and while b. knitting a first leg, c. knitting a curved intermediate panty portion, d. knitting a second leg, e. reducing the size of the stitch loops in courses of at least said panty portion from large stitch loops along one side of said blank to small stitch loops along the opposite side of said blank, to provide a curvature in the panty portion solely by reducing the size of the stitches, and f. slitting the intermediate portion of said panty hose blank to form a waist opening therein.

* * * * *

UNITED STATES PATENT OFFICE

CERTIFICATE OF CORRECTION

PATENT NO. : 3,937,039
DATED : February 10, 1976
INVENTOR(S) : Ronald W. Anderson It is certified that error appears in the above-identified patent and that said Letters Patent are hereby corrected as shown below:

Column 1, line 7, change "tubulr" to ---tubular---

Column 1, line 19, change "are" to ---area---

Column 1, line 24, after "objects" insert ---and---

Column 9, line 50, after "loops" insert ---positioned in a wale extending along the---

Signed and Sealed this

*fourth* Day of *May 1976*

[SEAL]

*Attest:*

RUTH C. MASON
*Attesting Officer*

C. MARSHALL DANN
*Commissioner of Patents and Trademarks*